US010446061B2

(12) United States Patent
Hansen et al.

(10) Patent No.: US 10,446,061 B2
(45) Date of Patent: Oct. 15, 2019

(54) SELF-MASKING LABEL

(71) Applicant: HellermannTyton Corporation, Milwaukee, WI (US)

(72) Inventors: Steve Hansen, Oshkosh, WI (US); James A. Petersen, Hartford, WI (US)

(73) Assignee: HELLERMANNTYTON CORPORATION, Milwaukee, WI (US)

( * ) Notice: Subject to any disclaimer, the term of this patent is extended or adjusted under 35 U.S.C. 154(b) by 223 days.

(21) Appl. No.: 15/389,551

(22) Filed: Dec. 23, 2016

(65) Prior Publication Data

US 2017/0186343 A1 Jun. 29, 2017

Related U.S. Application Data

(60) Provisional application No. 62/387,239, filed on Dec. 23, 2015.

(51) Int. Cl.

| | |
|---|---|
| ***G09F 3/10*** | (2006.01) |
| ***G09F 3/00*** | (2006.01) |
| ***B65C 9/00*** | (2006.01) |
| ***G09F 3/20*** | (2006.01) |
| *B65C 3/02* | (2006.01) |
| *G09F 3/02* | (2006.01) |

(52) U.S. Cl.

CPC ..... *G09F 3/0288* (2013.01); *B65C 9/0006* (2013.01); *G09F 3/0295* (2013.01); *G09F 3/205* (2013.01); *B65C 3/02* (2013.01); *G09F 3/10* (2013.01); *G09F 2003/0222* (2013.01); *G09F 2003/0227* (2013.01)

(58) Field of Classification Search

CPC .. G09F 3/10; G09F 3/0288; G09F 2003/0227; G09F 2003/0222

See application file for complete search history.

(56) References Cited

U.S. PATENT DOCUMENTS

| | | | |
|---|---|---|---|
| 4,091,718 | A | 5/1978 | Thornhill |
| 4,420,520 | A | 12/1983 | Jones et al. |
| 4,579,759 | A | 4/1986 | Breuers |
| 4,609,208 | A | 9/1986 | Wrobel |
| 5,056,827 | A | 10/1991 | Sasso |

(Continued)

FOREIGN PATENT DOCUMENTS

| | | | |
|---|---|---|---|
| CN | 101760146 | A | 6/2010 |
| CN | 104067332 | A | 9/2014 |

(Continued)

OTHER PUBLICATIONS

International Search Report and Written Opinion pertaining to PCT/US16/68483, dated Mar. 30, 2017, 10 pages.

*Primary Examiner* — Scott W Dodds
(74) *Attorney, Agent, or Firm* — Robert J. Myers

(57) ABSTRACT

A self-masking label and method of use for wrapping about elongate articles. The label includes a series of label sections positioned end-to-end along the length of the label and supported on a carrier strip during printing. A first label section is configured to be marked or printed with indicia; a second label section may be transparent; a third label section is arranged to overlap the first and second sections and to cover and protect the indicia, during for example, an over-coating procedure; and a fourth label section includes a non-sticky tab section.

5 Claims, 10 Drawing Sheets

(56) References Cited

U.S. PATENT DOCUMENTS

| | | | | |
|---|---|---|---|---|
| 5,376,418 | A | 12/1994 | Rogers et al. | |
| 5,618,600 | A | 4/1997 | Denklau | |
| 5,631,055 | A | 5/1997 | Vines et al. | |
| 5,654,056 | A | 8/1997 | Combe | |
| 5,800,894 | A | 9/1998 | Navis | |
| 6,277,458 | B1 | 8/2001 | Dirksing et al. | |
| 6,656,558 | B1 | 12/2003 | Sarajian | |
| 6,962,748 | B2 | 11/2005 | Nickel | |
| 7,114,446 | B2 | 10/2006 | Sellars | |
| 7,195,689 | B2 | 3/2007 | Adams et al. | |
| 7,374,633 | B2 | 5/2008 | Sellars | |
| 7,854,978 | B1 | 12/2010 | Nygard | |
| 8,263,201 | B2 | 9/2012 | Caveney et al. | |
| 2005/0076833 | A1 | 4/2005 | Wechselberger et al. | |
| 2005/0136207 | A1* | 6/2005 | Moosheimer ..... | A61M 5/178 428/40.1 |
| 2009/0277570 | A1 | 11/2009 | Caveney et al. | |
| 2010/0059162 | A1 | 3/2010 | Flanigan | |
| 2011/0259775 | A1 | 10/2011 | Bratter et al. | |
| 2015/0339956 | A1* | 11/2015 | Turner ..... | G09F 3/0288 156/249 |

FOREIGN PATENT DOCUMENTS

| | | | |
|---|---|---|---|
| EP | 535843 | A2 | 4/1993 |
| EP | 2283477 | A1 | 2/2011 |
| EP | 2581897 | A1 | 4/2013 |
| JP | 59222266 | A | 12/1984 |
| JP | 60144377 | A | 7/1985 |
| WO | WO 2013/096622 | | 6/2013 |

* cited by examiner

SELF-MASKING LABEL

RELATED APPLICATION

This application claims the benefit of U.S. Provisional Patent Application Ser. No. 62/387,239, filed 23 Dec. 2015.

BACKGROUND OF THE INVENTION

Identification labels are frequently affixed to elongate articles, including bundled elongate articles, such as wires, cables, hoses, tubing, fiber optics, conduits, vines, and the like, to assist in identifying the electrical circuit, or other system, the elongate items comprise. It is important that such elongate objects are identifiable in the event that the system requires repair, change or otherwise needs maintenance. Moreover, identification labels are often needed to meet certain compliance requirements, such as ANSI/TIA/EIA-606-A. Typical labels for such use have an adhesive surface and an opposed printable surface. The elongate article or bundled elongate articles may be further secured to a supporting chassis or framework. Such applications are common, for example, in cars, trucks, airplanes, ships, boats and other vehicles.

Examples of labels used in such environments include tubular or cylindrical labels having markings applied to the outer surface, sleeve-type labels, and adjustable label strips. While these prior labels may be suitable in some application conditions, they may be insufficient in certain conditions, particularly in conditions which require that the labeled elongate object undergo an over-coating procedure. Over-coating may be necessary when, for example, the labeled elongate object is attached to an article requiring painting, such as an automotive. In such instances labeled elongate articles, such as electrical wiring, may be first fastened to a chassis, and the chassis is subsequently painted or otherwise sprayed with a protective coating. Any identifying printing on the label is also coated thereby obliterating the printed matter. Therefore there exists a need for a self masking label that is adapted for use with elongate articles, is easy to apply, is able to withstand an over-coating procedure, all while preserving the readability of the printed information after an over-coating procedure.

SUMMARY OF THE INVENTION

The present invention is directed to a self masking label having wrapping capability, particularly wrapping about elongate articles. The label may include a strip of pressure sensitive film material having a series of label sections positioned end-to-end along the length of the label. The label may be positioned on a carrier strip or other suitable device during printing and may be removed from the carrier strip and wrapped around an elongate article to be labeled. The label preferably includes a first label section configured to be marked or printed with indicia; a second, preferably transparent, label section; a third label section configured to overlap the first and second sections, and to cover and protect the indicia section, during for example, an over-coating procedure, the third label section may be delineated by and area of weakness, such as perforations; and a fourth label section including a non-sticky tab section. The first, second and third sections preferably include adhesive on at least one side, with the adhesive of the third section being less sticky than that of the first and second sections, thereby allowing facile removal of the third section after over-coating of the elongate object, by pulling the non-sticky tab in the opposite direction of label application.

A method of use is further provided wherein the label is printed on a first label portion, the printed label is positioned around an elongate object, and the elongate object is over coated. The third label section is removed after over-coating and the printing or other indicia on the first section underneath is revealed. The third and fourth sections may be thereafter by removed from the second section by separation at a perforated border between the second and third label sections, making for a quick and easy break. Alternatively, the third section may include an area of weakness for separation into first and second portions.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention.

Figure 1:
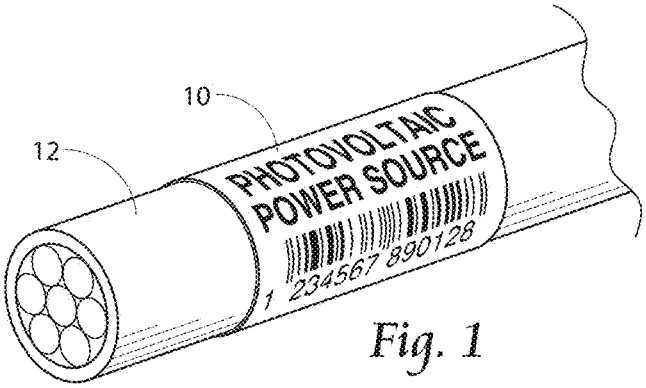
FIG. 1 is a fragmentary perspective view of an elongate article having a label according to the present invention affixed thereto.
Figure 2:
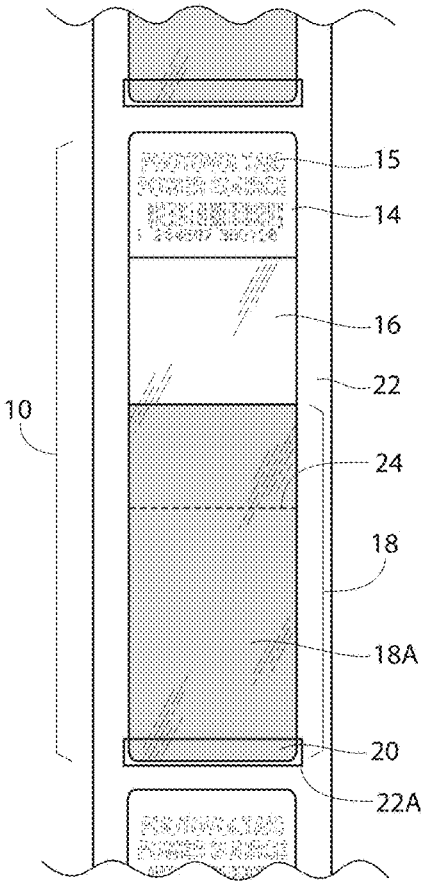
FIG. 2 is a fragmentary top plan view of a carrier strip and label according to the present invention.
Figure 3A:
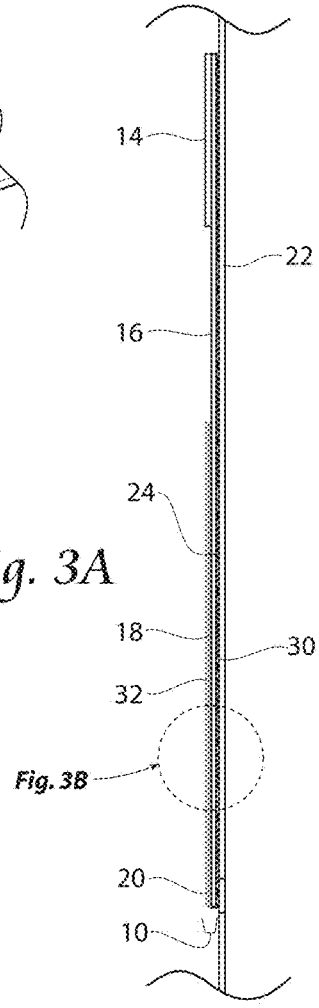
FIG. 3A is a fragmentary side view of the carrier strip and label illustrated in FIG. 2.
Figure 3B:
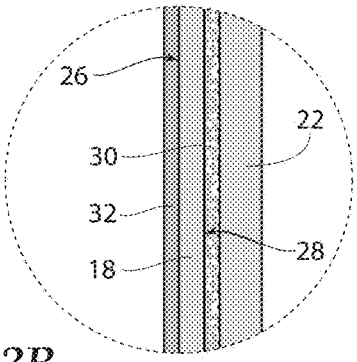
FIG. 3B is an enlarged view of area 3B in FIG. 3A
Figure 4:
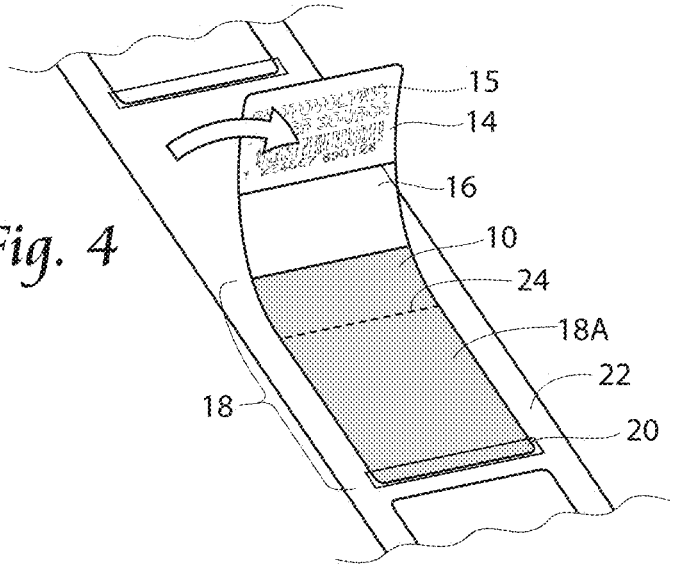
FIG. 4 is a fragmentary perspective view of the carrier strip and label illustrated in FIGS. 2 and 3A, but showing the label partially removed from the carrier strip.

With attention to FIG. 1, a label 10 according to the present invention in place about an elongate article 12 may be seen. An elongate article 12 for use in conjunction with the present label 10 may include, without limitation, bundled elongate articles, such as wires, cables, hoses, tubing, fiber optics, conduits, vines, and the like. As shown in FIG. 2, a label 10 according to the present invention may include a strip of pressure sensitive film material having a series of label sections 14, 16, 18, 20 positioned end-to-end along the length of the label 10. The label 10 may be positioned on a carrier strip 22 or other suitable device during printing, and may be removed from the carrier strip 22 and wrapped around an elongate article 10 to be labeled. As shown, a first label section 14 is configured to be marked or printed with indicia 15; a second label section 16 may be transparent; and a third label section 18 is arranged to overlap to cover and protect the first and second sections 14, 16 during for example, an over-coating procedure. Examples of over-coating procedures include painting, spraying, or application of any other material that may render printed indicia 15 unreadable by application thereon. As further shown, a portion 18A of the third label section 18 is separable from the label 10 by wav of an area of weakness, such as the perforations 24 illustrated. The label 10 further preferably includes a fourth tab section 20. Each of the label sections, 14, 16, 18, 20, includes a top surface 26 and a bottom surface 28, with at least one of the surfaces 26, 28 preferably including adhesive 30 thereon (see for example, FIG. 3B).

Figure 5:
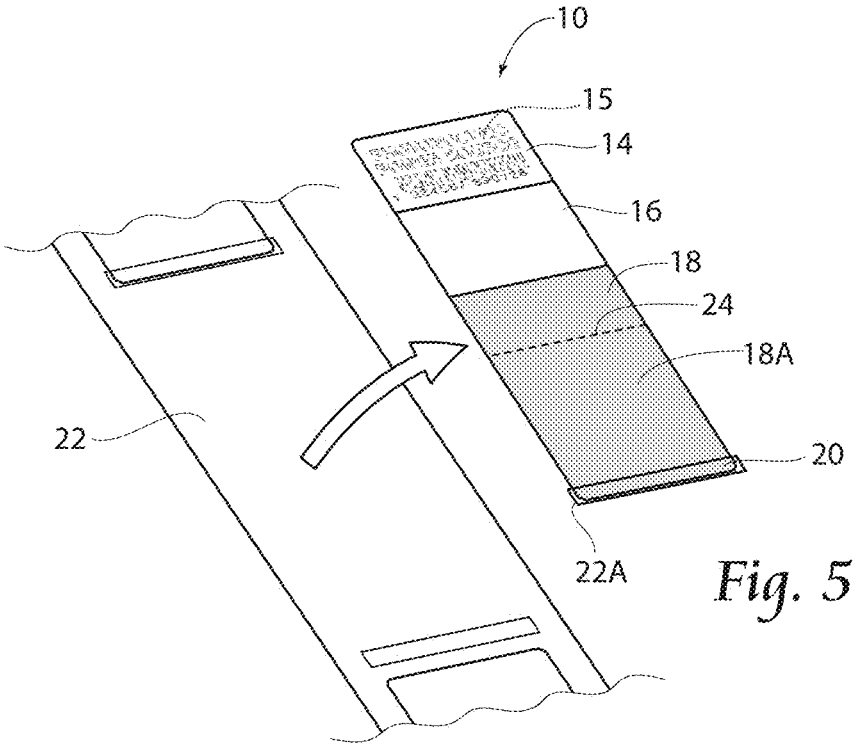
FIG. 5 is a view similar to that of FIG. 4, but showing the label removed from the carrier strip.

As viewed particularly in FIG. 5, the fourth, tab section 20 preferably retains a portion 22A of the carrier strip 22 when the label 10 is removed from the carrier strip 22. The portion 22A covers the adhesive 30 such that the fourth tab section 20 is a non-sticky section. With further attention to FIG. 3B, the third section 18 preferably includes a top surface 26 having an adhesive resistant coating, such as the silicone coating 32 shown. The silicone coating 32 allows facile removal of the separable portion 18A from the wrapped label 10 after the elongate object 12 has been over-coated, as will be discussed.

FIGS. 4-14 illustrate a method of using a label 10 as described with reference to FIGS. 1-3B. As shown, the label 10 is printed on the top surface 26 of the first label portion 14 with indicia 15 or other markings, and the label 10 is removed from the carrier strip 22. The view of FIG. 5 particularly shows portion 22A adhered to the fourth tab section 20 as the label 10 is removed from the main carrier strip 22. Portion 22A is preferably precut from the carrier strip 22 during the label making process such that it is carried by the fourth, tab section 20 during label 10 removal.

Figure 6A:
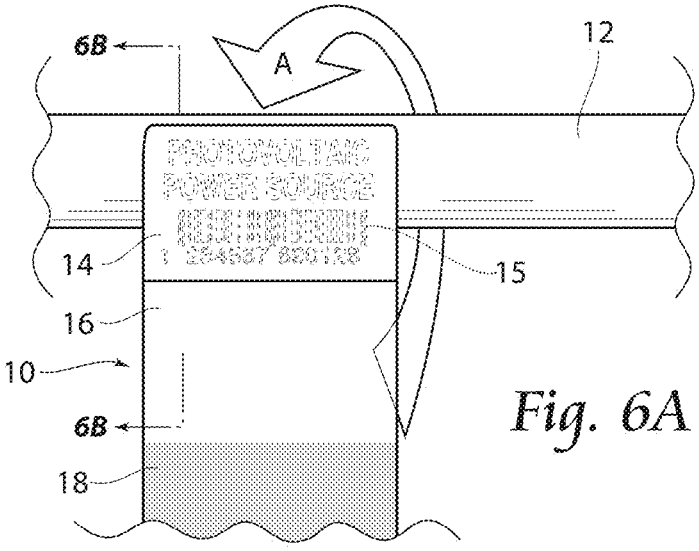
FIG. 6A is a fragmentary front view showing a first step in applying the label to an elongate item.
Figure 6B:
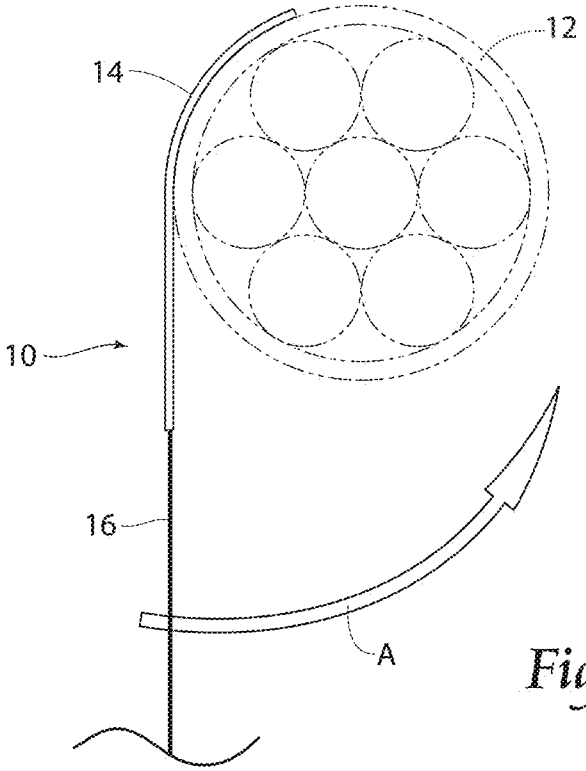
FIG. 6B is a cross sectional view of the step illustrated in FIG. 6A and taken along line 6B-6B thereof.
Figure 7A:
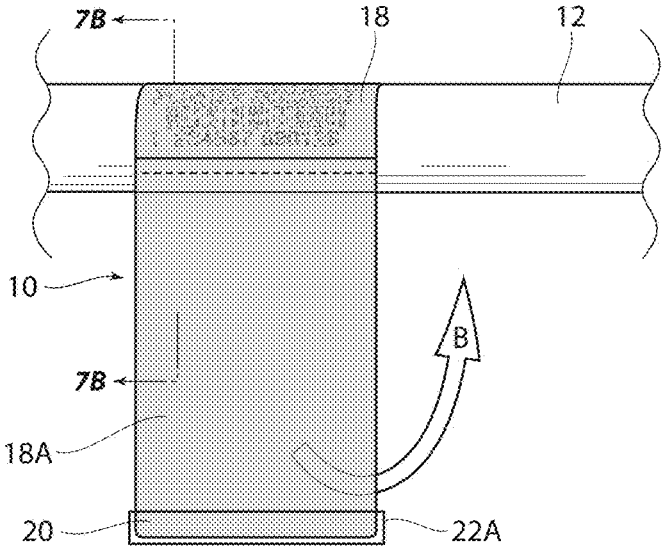
FIG. 7A is a fragmentary front view showing a next step in applying the label to an elongate item.
Figure 7B:
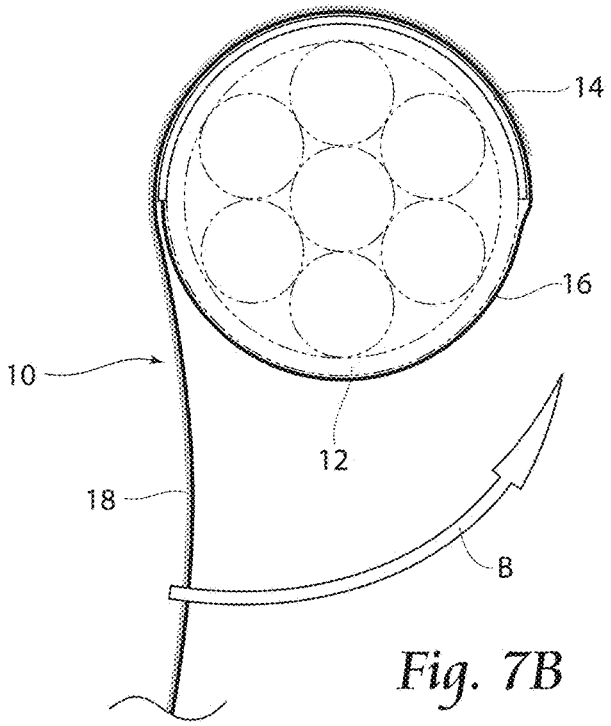
FIG. 7B is a cross sectional view of the step illustrated in FIG. 7A and taken along line 7B-7B thereof.
Figure 8A:
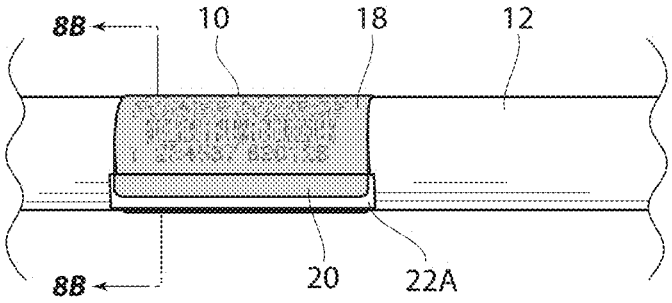
FIG. 8A is a fragmentary front view showing a next step in applying the label to an elongate item.
Figure 8B:
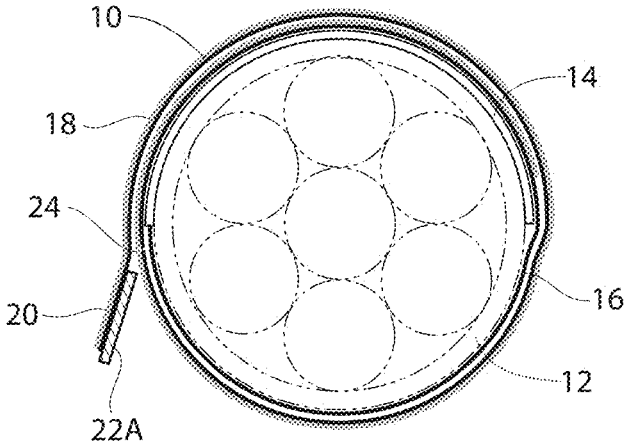
FIG. 8B is a cross sectional view of the step illustrated in FIG. 8A and taken along line 8B-8B thereof.
Figure 9:
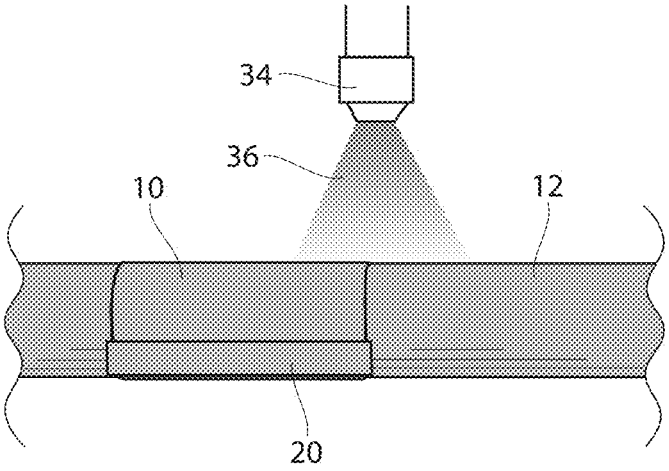
FIG. 9 is a fragmentary front view showing a label in place on an elongate article and during an over-coating procedure.

FIGS. 6A and 6B illustrate a next step in a method of using the label 10. The printed label 10 is aligned with an elongate object 12 and wrapped in the direction of arrow A. Continued application of the label 10 in the direction of arrow B may be seen in FIGS. 7A and 7B, wherein wrapping of the label 10 positions the third section 18 over the first, printed section 14 and second section 16. The views of FIGS. 8A and 8B illustrate the label 10 secured about an elongate object 12 and ready for an over-coating procedure. The view of FIG. 9 depicts the step of over-coating by, for example, a spray nozzle 34 and protective paint 36, although it is to be understood that it is within the scope of the invention to include other over-coating devices and coatings.

Figure 13:
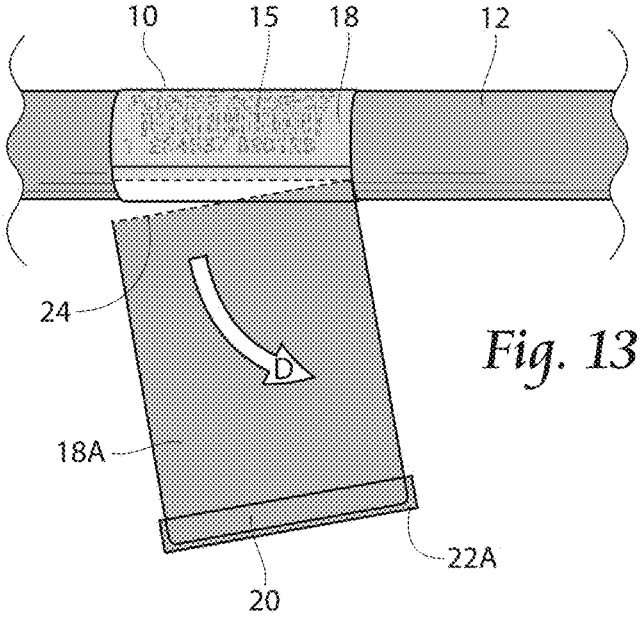
FIG. 13 is a fragmentary view, similar to that of FIGS. 9, 10, and 11, but showing a next step in removing a portion of the label after an over-coating procedure.
Figure 14:
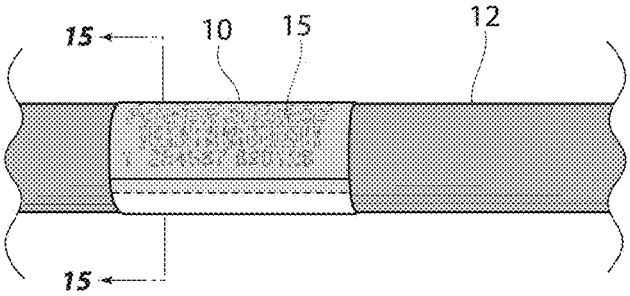
FIG. 14 is a fragmentary view, similar to that of FIGS. 9, 10, 11 and 13, but showing a next step after an over-coating procedure.
Figure 15:
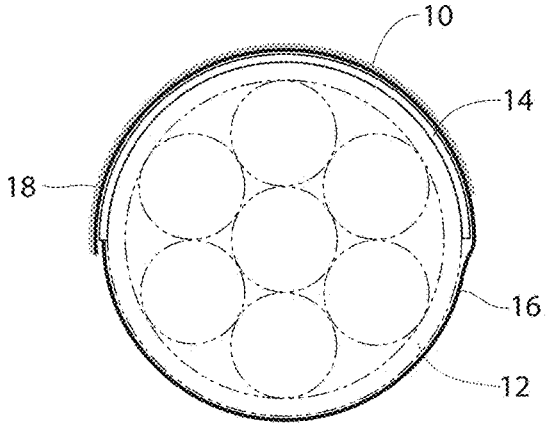
FIG. 15 is a cross sectional view of the step illustrated in FIG. 14 and taken along line 15-15 thereof.
Figure 16:
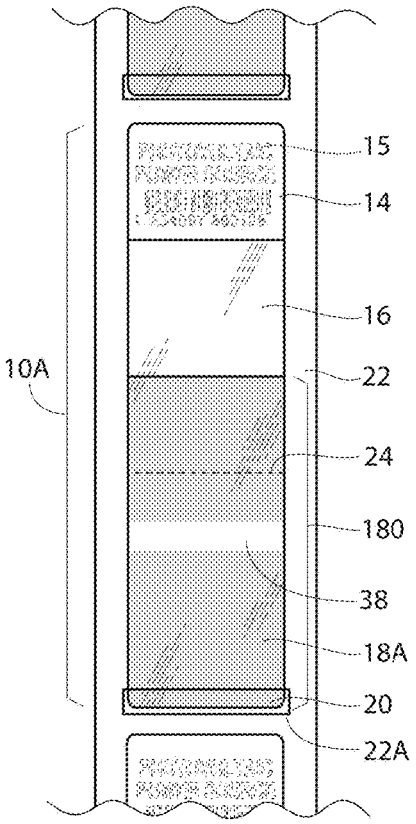
FIG. 16 is a fragmentary top plan view of a carrier strip having another label according to the present invention.
Figure 17B:
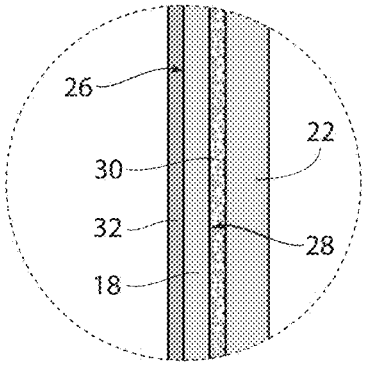
FIG. 17B is an enlarged view of area 17B illustrated in FIG. 17A.
Figure 17A:
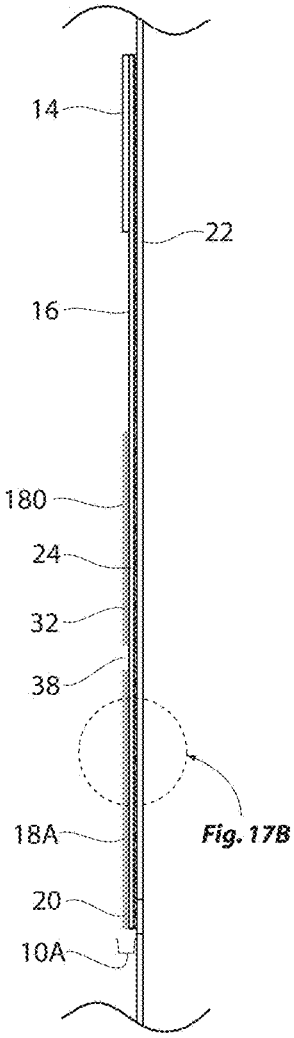
FIG. 17A is a fragmentary side view of the carrier strip and label illustrated in FIG. 16.

The views of FIGS. 10-15 illustrate the elongate object 12 and the attached label 10 after an over-coating step. With specific attention to FIGS. 10 and 11, it may be seen that the fourth, non-sticky tab section 20 is not adhered to the label 10 due to the presence of portion 22A. Removal of the separable portion 18A is initiated by pulling the fourth, non-sticky tab section 20 in the direction of arrow C, in an opposite direction of label application, until the separable portion 18A of the third label section 18 is unwound and the perforations 24 are exposed. As seen in FIG. 13, the separable portion 18A of the third label section 18 is pulled in the direction of arrow D and removed along perforations 24. The resultant, labeled elongate object 12 is shown in FIGS. 14 and 15 wherein the printed first label portion 14 is covered by the remaining portion of third label section 18. In this manner, the printing or other indicia 15 on the first label section 14 is viewable since it was protected during the over-coating step by the now removed separable portion 18A of the third label section 18.

FIGS. 16-18B illustrate another embodiment of a label 10A according to the present invention. As shown, and similar to the embodiment illustrated in FIGS. 1-15, the label 10A of these views preferably includes a strip of pressure sensitive film material having a series of label sections positioned end-to-end along the length of the label 10A. The label 10A may be positioned on a carrier strip 22 or other suitable device during printing and may be removed from the carrier strip 22 and wrapped around an elongate article 12 to be labeled. The label 10A includes sections similar to that of the previously described label 10, including a first label section 14 configured to be marked or printed with indicia 15; a second transparent label section 16; and a third label section 180 configured to overlap the second section 16 during for example, an over-coating procedure. A portion 18A of the third label section 180 is separable from the label 10A by way of an area of weakness, such as the perforations 24 shown. The label 10A also preferably includes a fourth, tab section 20. Each of the label sections, 14, 16, 180, 20, includes a top surface 26 and a bottom surface 28, with at least one of the surfaces 26, 28 preferably including adhesive 30 thereon (see FIG. 17B). As in the previous embodiment, and viewed in FIG. 18A, the fourth tab section 20 retains a portion 22A of the carrier strip 22 when the label 10A is removed from the carrier strip 22. The third section 180 preferably includes a top surface 26 having an adhesive resistant coating, such as the silicone coating 32 shown (see FIG. 17B) to allow facile removal of the separable portion 18A from the wrapped label 10 after the elongate object 12 has been over-coated. With particular attention to the view of FIG. 16, it may be seen that the silicone coating 32 of separable portion 18A of the third section 180 is discontinuous, wherein the too surface 26 includes a silicone free zone 38. The silicone free zone 38 allows further ease in attaching and securing the label 10A in wrapped condition during coating, as will be discussed.

Figure 10:
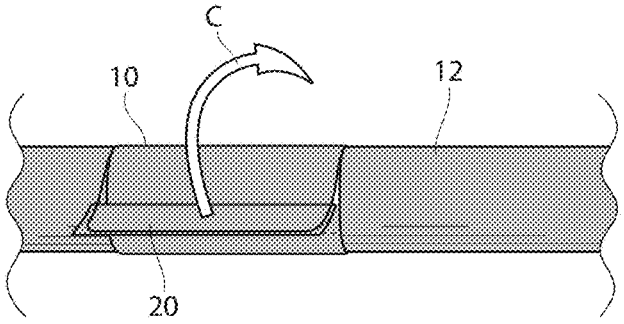
FIG. 10 is a fragmentary view, similar to that of FIG. 9, but showing a step in removing a portion of the label after an over-coating procedure.
Figure 11:
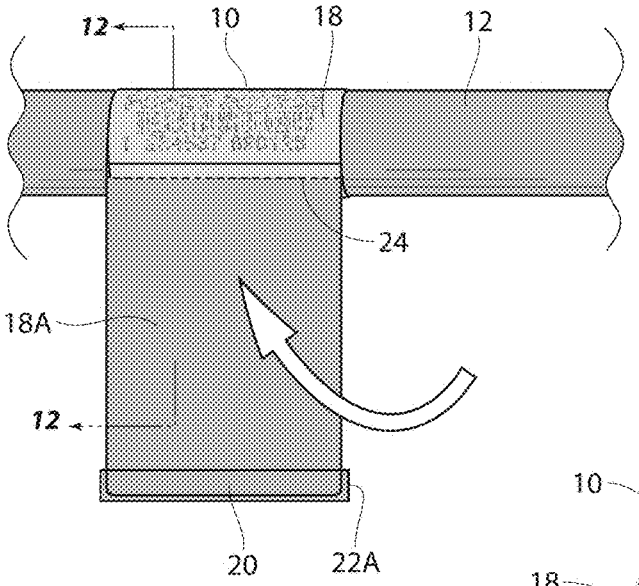
FIG. 11 is a fragmentary view, similar to that of FIGS. 9 and 10, but showing a next step in removing a portion of the label after an over-coating procedure.
Figure 12:
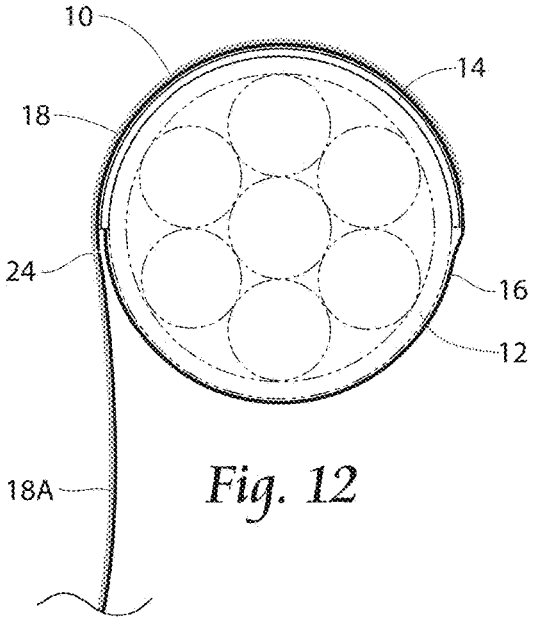
FIG. 12 is a cross sectional view of the step illustrated in FIG. 11 and taken along line 12-12 thereof.
Figure 18A:
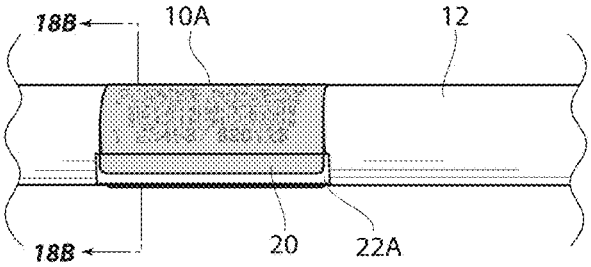
FIG. 18A is a fragmentary front view showing the label illustrated in FIGS. 16-17B and attached to an elongate item.
Figure 18B:
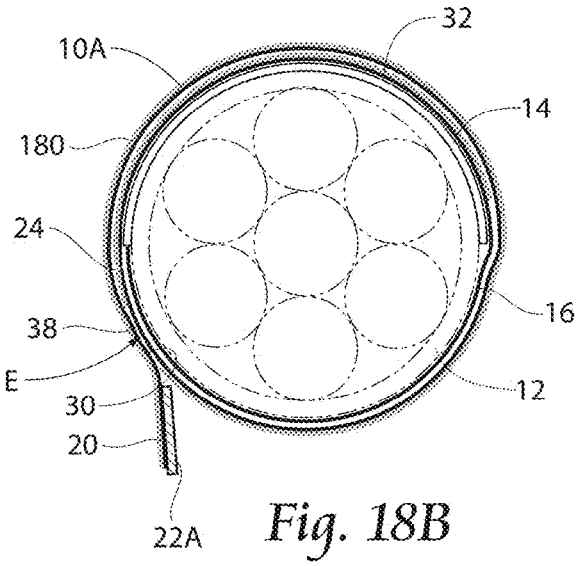
FIG. 18B is a cross sectional view of the label illustrated in FIG. 18A and taken along line 18B-18B thereof.

FIGS. 18A-18B illustrate the label 10A in place about an elongate article 12 and in condition for an over-coating procedure. The method of using label 10A is similar to that described with reference to FIGS. 4-14, wherein the label 10A is printed on the first surface 26 of the first label portion 14, and the label 10A removed from the carrier strip 22, leaving a portion 22A of the carrier strip 22 attached to the fourth, tab section 20. The printed label 10A is positioned around an elongate object 12 in the manner described in reference to FIGS. 6A-7B, wherein first, printed section 14 is positioned over the elongate article 12, with the second label section 16 and third label section 180 completing the wrap. The view of FIG. 18B depicts the label 10A, around an elongate article 12 and particularly illustrates the silicone free zone 38 and the adhesive 30 on the third section 180 connected at point of attachment E. Point of attachment E provides stability to the label 10A during an over-coating process and reduces the incidence of the label 10A coming free before the over-coating process is complete. After the elongate object 12 and the attached label 10A have been over-coated, the fourth, non-sticky tab section 20 is pulled as shown in FIGS. 10 and 11, in the direction of arrow C, until the separable portion 18A of the third label section 180 is unwound exposing the perforations 24. The separable portion 18A of the third label section 180 is removed as illustrated in FIG. 13.

Figure 19:
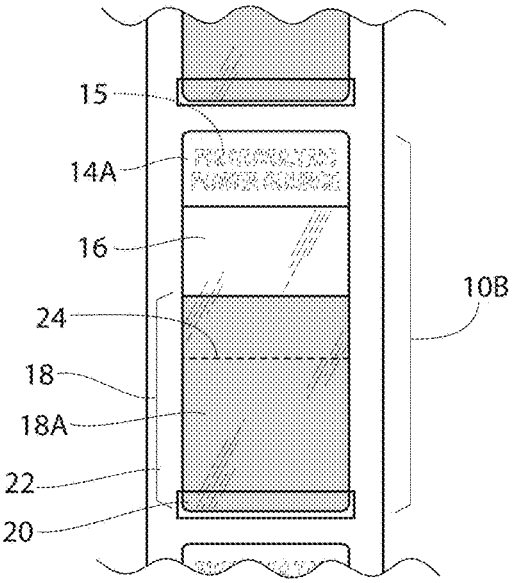
FIG. 19 is a fragmentary top plan view of a carrier strip having another label according to the present invention.

FIG. 19 illustrates another embodiment of a label 10B according to the present invention. Similar to the embodiments illustrated in FIGS. 1-18B, the label 10B includes a strip of pressure sensitive film material having a series of label sections positioned end-to-end along the length of the label 10B. The label 10B may be positioned on a carrier strip 22 or other suitable device during printing and may be removed from the carrier strip 22 and wrapped around an elongate article 12 to be labeled. As shown, and similar to the previously described label, a first label section 14A is configured to be marked or printed with indicia 15; a second transparent label section 16; and a third label section 18 arranged to overlap the first and second sections 14A, 16 to cover and protect the sections 14A, 16 during for example, an over-coating procedure. The label 10B of this view illustrates varied relative sizes of the sections 14A, 16, and 18, wherein the first, printed section 14A may be sized to accommodate a preferred layout and amount of the printing 15. As in previous embodiments, a portion 18A of the third label section 18 is separable from the label 10A by way of perforations 24 and the label 10B further preferably includes a fourth, tab section 20. Each of the label sections, 14A, 16, 18, 20, preferably includes an adhesive 30 thereon wherein the fourth tab section 20 retains a portion 22A of the carrier strip 22 when the label 10B is removed from the carrier strip 22. As in the previous embodiments, the third section 18 further preferably includes a top surface 26 having an adhesive resistant coating, such as the silicone coating 32 shown (see FIG. 17B) to allow facile removal of the separable portion 18A from the wrapped label 10B after the elongate object 12 has been over-coated.

FIGS. 20-23 illustrate another embodiment of a label 10C according to the present invention wherein the label 10C may be seen to have two portions 40, 42. The label 10C is for use in conjunction with an elongate article 12 having a large circumference that may also require large indicia 15. The label 10C includes two strips or portions 40, 42 of pressure sensitive film material, each having a series of label sections positioned end-to-end along the length of the label 10C. The label 10C may be positioned on a carrier strip 22 or other suitable device during printing and may be removed from the carrier strip 22 and wrapped around an elongate article 12 to be labeled. As shown, and similar to previously described labels, the first portion 40 includes a first label section 14 that is configured to be marked or printed with indicia 15, a second transparent label section 16, and a third label section 18 is configured to overlap the first section 14 during for example, an over-coating procedure. The label 10C of this view illustrates a two part construction wherein the first portion 40 may be applied first, followed by the second portion 42 which is configured to overlap the first portion 40. The second portion 42 includes a mask section 44 and a tab section 20. Each of the label sections, 14, 16, 18, 20, and 44 preferably includes an adhesive 30 thereon wherein the fourth tab section 20 retains a portion 22A of the carrier strip 22 when the second portion 42 is removed from the carrier strip 22. As in the previous embodiments, the third section 18 further preferably includes a to surface 26 having an adhesive resistant coating, such as the silicone coating 32 shown (see FIG. 17B) to allow facile removal of the mask section 46 from the wrapped label 10C after the elongate object 12 has been over-coated. The first and second portions 40, 42 may further include registration markings 46 to aid in alignment during use, as will be discussed.

Figure 20:
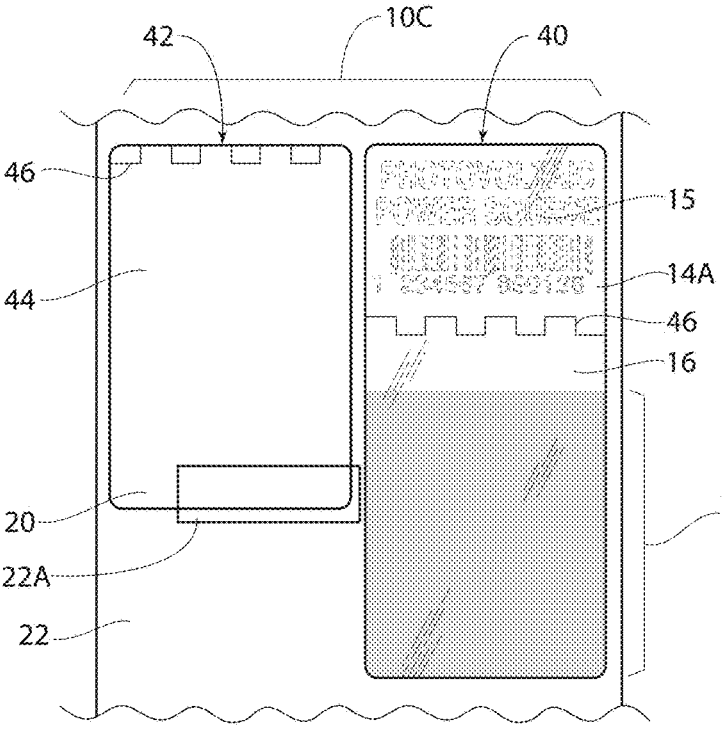
FIG. 20 is a fragmentary top plan view of a carrier strip having another label according to the present invention.
Figure 21:
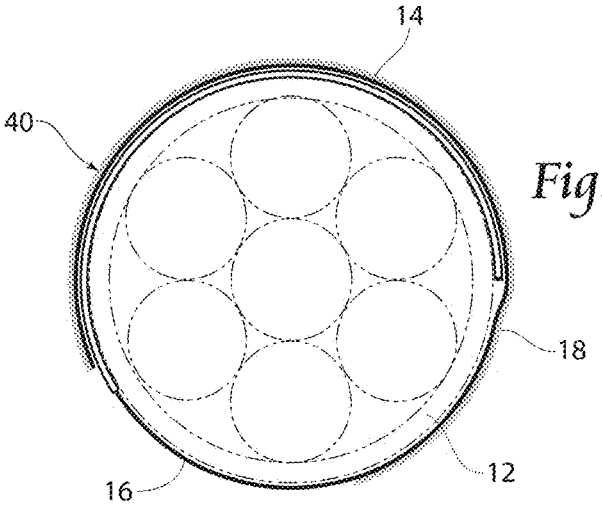
FIG. 21 is a cross sectional view showing an elongate object with a first portion of the label illustrated in FIG. 20 applied.
Figure 22:
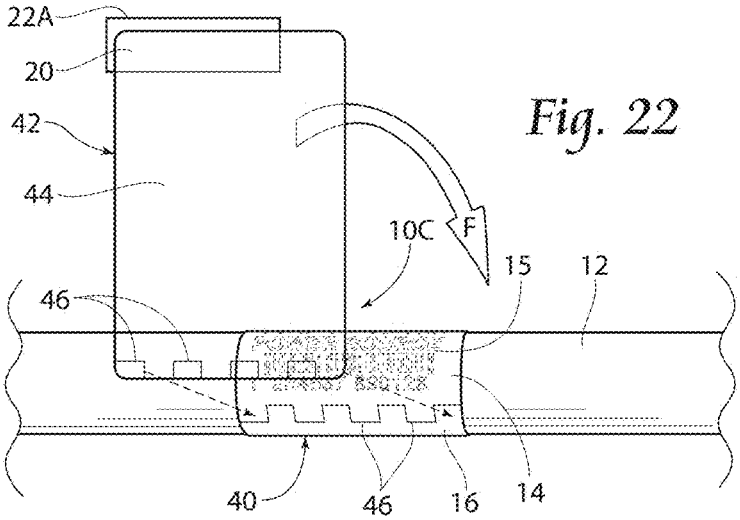
FIG. 22 fragmentary front view showing a next step in applying the label illustrated in FIG. 20 to an elongate item, with the second portion being aligned with registration markings.
Figure 23:
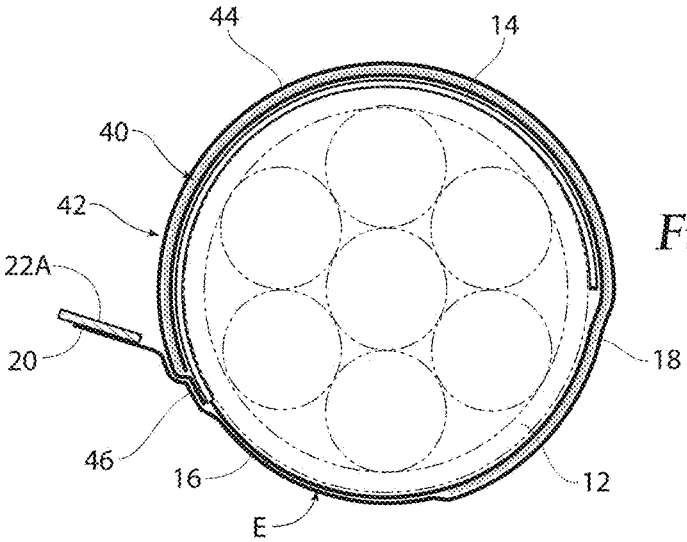
FIG. 23 is a view similar to that of FIG. 21, but showing the second portion of the label illustrated in FIG. 20 applied to an elongate article.

FIGS. 21-23 illustrate a method of using a label 10C as shown in FIG. 20. The label 10C first portion 40 is first printed on the top surface 26 of the first label section 14 with indicia 15 or other markings. The first portion 40 is provided with a second label section 16 and a third section 18. As mentioned, the third label section 18 includes a silicone coating 32, while the section label section 16 is preferably of a transparent, non-silicone coated material. The first portion 40 is removed from the carrier strip 22 and is wrapped about an elongate article 12, as is shown in FIG. 21. In a next step, a second portion 42 is provided. The second portion 42 includes a mask section 44 and the fourth tab section 20 having portion 22A adhered. The second portion 42 is removed from the carrier strip 22 and registration markings 46 are aligned with the corresponding registration markings 46 on the first portion 40. Alignment of the portions 40, 42 ensures that the first label section 14 and printed indicia 15 are properly covered and protected during over-coating. As shown in FIG. 22, the second portion 44 is wrapped about the elongate article 12 in the direction of arrow F and over the first portion 40, as is shown in FIG. 23. The mask section 44 of the second portion 42 overlays and protects the indicia 15 during the previously described over-coating procedure. As in previously described embodiments, when the second portion 42 is removed from the main carrier strip 22, precut portion 22A is carried by the fourth, tab section 20 to facilitate removal after over-coating. Next, the article 12 and label 10C are over-coating in a manner described with regard to FIG. 9. After an over-coating step, the fourth, non-sticky tab section 20 is pulled until the second portion 42 is unwound and the first portion 40 is exposed. As in the embodiment illustrated with regard to FIG. 16-18A, the silicone free area, on this embodiment understood to be label section 16, connects with the adhesive 30 on the mask section 44 at point of attachment E. Point of attachment E provides stability to the label 10C during an over-coating process and reduces the incidence of the label 10C coming free before the over-coating process is complete.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention.

We claim:

1. A self-masking label configured to be wrapped around an elongate article, comprising:

a first label section having a first top surface configured to be marked with indicia and a first bottom surface on which an adhesive is disposed, wherein the first bottom surface is configured to contact the elongate article;

a second label section having a second top surface and a second bottom surface on which an adhesive is disposed, wherein the second bottom surface is configured to contact the first top surface;

a third label section separated from the second label section by a perforation and configured to overlap the second label section, wherein the third label section has a third top surface on which an adhesive resistant coating is disposed and a third bottom surface on which an adhesive is disposed, wherein the third bottom surface is configured to contact the second top surface and wherein the third top surface includes a zone that is free of the adhesive resistant coating;

a fourth label section including a fourth top surface and a fourth bottom surface on which an adhesive is disposed, wherein the fourth bottom surface is configured to contact the third top surface; and a carrier strip in contact with the first, second, third, and fourth bottom surfaces and wherein a portion of the carrier strip is configured to be retained to the fourth bottom surface when the label is removed from the carrier strip.

2. The self-masking label according to claim 1, wherein the second label section is transparent.

3. The self-masking label according to claim 1, wherein the portion of the carrier strip covers the adhesive on the fourth bottom surface.

4. The self-masking label according to claim 1, wherein the adhesive resistant coating is a silicone coating.

5. The self-masking label according to claim 1, wherein the portion of the carrier strip is cut from the carrier strip.

* * * * *